United States Patent [19]

Prikhodko et al.

[11] Patent Number: 4,606,398

[45] Date of Patent: Aug. 19, 1986

[54] METHOD AND APPARATUS FOR ELECTROHYDROBLASTING OF CASTINGS

[76] Inventors: Valery V. Prikhodko, ulitsa Chaikovskogo, 6a, kv. 54; Boris V. Kostyrkin, prospekt Lenina, 158, kv. 25; Pavel I. Tsarenko, ulitsa Frunze, 84, kv. 85, all of Nikoleav, U.S.S.R.

[21] Appl. No.: 636,966

[22] Filed: Aug. 2, 1984

Related U.S. Application Data

[62] Division of Ser. No. 367,878, Apr. 13, 1982, Pat. No. 4,490,180.

[51] Int. Cl.[4] ..... B22D 27/08; B22D 29/00

[52] U.S. Cl. ..... 164/510; 164/404; 164/511; 134/1

[58] Field of Search ..... 164/131, 132, 404, 510, 164/511; 134/1, 32

[56] References Cited

U.S. PATENT DOCUMENTS

| | | | |
|---|---|---|---|
| 1,734,176 | 11/1929 | McCabe | 164/404 |
| 3,845,806 | 11/1974 | Schekin et al. | 164/131 |
| 4,022,266 | 5/1977 | Vershinsky et al. | 164/132 |
| 4,198,995 | 4/1980 | Kachkarov et al. | 134/133 |

FOREIGN PATENT DOCUMENTS

| | | | |
|---|---|---|---|
| 1303223 | 1/1973 | United Kingdom | 164/404 |
| 0463299 | 10/1977 | U.S.S.R. | 164/132 |
| 0703236 | 12/1979 | U.S.S.R. | 164/404 |
| 0728992 | 4/1980 | U.S.S.R. | 164/404 |
| 0804201 | 2/1981 | U.S.S.R. | 164/131 |

*Primary Examiner*—Nicholas P. Godici
*Assistant Examiner*—Richard K. Seidel
*Attorney, Agent, or Firm*—Burgess, Ryan & Wayne

[57] ABSTRACT

A method for electrohydroblasting of castings in a liquid medium with a view to removing core and molding sand, according to which castings are subjected to a series of electrohydraulic shocks and at the same time set in reciprocating motion. The reciprocating frequency of the castings and the length of their stroke are sufficient to produce a flow of liquid in the internal channels of the castings and thus remove core and molding sand therefrom. The method is carried out with the aid of an apparatus which comprises a casting-reciprocating mechanism interacting with an electrode-positioning mechanism so that the movement of the castings is synchronized with that of the electrode.

5 Claims, 5 Drawing Figures

METHOD AND APPARATUS FOR ELECTROHYDROBLASTING OF CASTINGS

This is a division, of application Ser. No. 367,878, filed Apr. 13, 1982, now U.S. Pat. No. 4,490,180.

FIELD OF THE INVENTION

The present invention relates to foundary practice and is specifically concerned with methods and apparatus for electrohydroblasting of castings.

The invention is applicable to the removal of core and molding sand from castings of complex shapes with developed internal cavities, such as cylinder heads.

DESCRIPTION OF THE PRIOR ART

There are known apparatus for cleaning castings of core and molding sand (cf. U.S. Pat. No. 3,845,806 of 1974) of the type which comprises a vessel filled with a liquid, a chamber arranged in the vessel and accommodating an electrode, and a device for loading castings into and removing them from the chamber.

There is also known casting cleaning apparatus (cf. U.S. Pat. No. 4,198,995 of 1980) of the type which comprises a vessel filled with a liquid and having vertical guides in which a lifting platform is installed. The apparatus further includes a mechanism for horizontal displacement of castings, an electrode-positioning mechanism, and a pulse current generator electrically connected to the electrode.

There is known a method for cleaning castings through the use of shock waves and flows resulting from an electrohydraulic discharge in a liquid medium (cf. USSR Inventor's Certificate No. 121053, Cl. B 22D 29/00 of 1959).

The method is disadvantageous in a low cleaning quality and a limited efficiency of the removal of loose sands.

Loose and other low-strength sands are so rapidly removed from the castings that the flow velocity of the sand through holes in the bottom of the container and in the castings is lower than the velocity of separation of the sand from the casting. As a result, the outlet openings are clogged with sand, which reduces the efficiency of the cleaning process. Furthermore, sand is not fully removed from cavities and recesses of the castings.

The method is carried out with the aid of an apparatus for electrohydroblasting of castings (cf. USSR Inventor's Certificate No. 415091, Cl. B 22D 29/00 of 1980), comprising a vessel filled with a liquid, a lifting platform mounted in vertical guides provided in the vessel and coupled to a drive mechanism, a container for castings, a mechanism for horizontal displacement of castings, a pulse current generator, and a working electrode mounted on an electrode-positioning mechanism and electrically connected to the pulse current generator. The electrode and the surface of a casting form a discharge gap in which a series of electrohydraulic shocks is produced.

The apparatus in question is disadvantageous in an incomplete removal of core and molding sand from internal cavities of complex-shaped castings and in a limited efficiency of the cleaning process.

SUMMARY OF THE INVENTION

It is an object of the present invention to provide a method and apparatus for electrohydroblasting of castings which would ensure an effective removal of core and molding sand from internal cavities of complex-shaped castings.

It is another object of the invention to improve the efficiency of the casting cleaning process.

It is still another object of the invention to ensure a better cleaning of castings of complex shapes.

The invention provides a method for electrohydroblasting of castings in a liquid medium with a view to removing core and molding sand therefrom by subjecting the castings to a series of electrohydraulic shocks, which method is characterized, in accordance with the invention, in that the castings are set in reciprocating motion at a speed and with a stroke length sufficient to produce a flow of liquid in internal cavities and holes of the castings and thus remove core and molding sand therefrom.

It is preferred that the speed at which the castings reciprocate should be greater than the product of a minimum flow velocity of liquid sufficient to remove stationary particles by the ratio between the total area of projections of the holes of all the castings on a plane extending at a perpendicular to the direction of their motion and the total cross-sectional area of all the castings. It is also preferred that the length of the stroke of castings should be greater than the product of the length of the longest channel by the ratio between the minimum flow velocity of liquid sufficient to remove stationary particles and the speed at which the castings reciprocate.

It is further preferred that the acceleration of the castings should be greater than the free fall acceleration.

The invention further provides an apparatus for electrohydroblasting of castings, comprising a vessel in which castings are submerged in a working liquid, a lifting platform installed in vertical guides provided in the vessel and having a drive mechanism, and a mechanism arranged above the vessel and intended for positioning an electrode disposed above the castings, spaced therefrom at a distance equal to the discharge gap length and intended to produce a series of electrohydraulic shocks, which apparatus is characterized, according to the invention, in that it includes a mechanism for setting the castings in reciprocating motion in the course of the cleaning process, which interacts with the electrode-positioning mechanism so that the movement of the castings is synchronized with that of the electrode.

It is preferred that the casting-reciprocating mechanism should include a platform arranged inside the vessel and carrying containers with castings, as well as a frame which supports the electrode-positioning mechanism so that it rests on the platform. The frame may be electrically connected to the pulse current generator.

It is further preferred that the casting-reciprocating mechanism and the mechanism for driving the lifting platform should be coupled to the frame secured to the lifting platform, mounted in the vertical guides and reciprocated by a mechanism provided with an eccentric means whose eccentricity is a multiple of the displacement of the castings during the electrohydroblasting process.

The casting-reciprocating mechanism and the mechanism for driving the lifting platform may have a common actuator.

The invention ensures a substantial improvement in the cleaning of castings, especially those of complex shapes.

BRIEF DESCRIPTION OF THE DRAWINGS

These and other objects and features of the present invention become readily apparent from the following description of preferred embodiments thereof taken in conjunction with the accompanying drawings, wherein.

DESCRIPTION OF THE PREFERRED EMBODIMENTS

Figure 1:
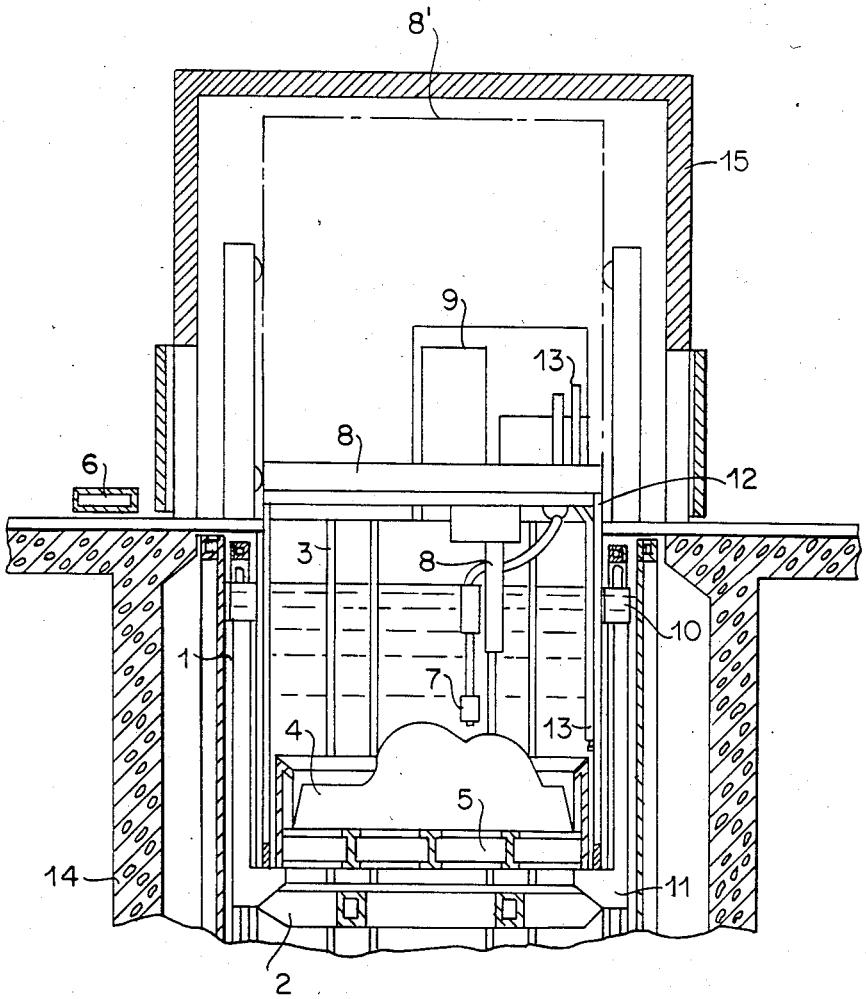
FIG. 1 is an elevation view of an apparatus for electrohydroblasting of castings, according to the invention.

The method for electrohydroblasting of casting consists of acting on castings with high-voltage current pulses so as to produce an electrical breakdown of the liquid in which the castings are submerged. This results in a heavy-current spark and an instantaneous application of a great amount of energy to the spark channel zone. The conductivity of the liquid in which the castings are submerged is at a level required for an effective electrohydroblasting process. The instantaneous application of a great amount of energy to the spark channel raises its temperature. The spark channel tends to expand. However, the liquid is practically incompressible and resists the expansion of the spark channel, whereby high instantaneous pressures are produced. This results in shock waves with an initial pressure of several thousand atmospheres and a supersonic propagation velocity. As the shock wave hits a casting, it loosens the core and molding sand and produces elastic vibrations in the material of the casting, which further loosen the core and molding sand.

As the electrohydroblasting process is started, the castings submerged in the working liquid are set in reciprocating motion so that liquid is displaced in internal cavities of the castings at a speed above 0.08 m/sec. At the moment the castings reverse their motion, the absolute value of their acceleration is greater than the free fall acceleration.

The reciprocating motion of the castings produces flows of liquid in their internal cavities, which remove the loosened core and molding sands. The velocity of the flow in the internal cavities of the castings is higher than 0.08 m/sec, i.e., the flow velocity known to be sufficient to remove stationary sand particles. As a casting reciprocates in a liquid medium, the velocity of liquid in the internal cavities of the casting relates to the velocity sufficient to remove stationary sand particles as follows:

$$v = v_0 k \frac{s_1}{s_0},$$

where $v_0$=0.08 m/sec, being the flow velocity just sufficient to remove stationary sand particles;

$s_1$ is the total area of holes of the casting;

k is a coefficient determined by the speed of reciprocating motion of the casting, the total area $s_1$ of the holes, and other parameters, as well as by the ratio between the area of the casting's surface and the area of the vessel which accommodates the castings; and $s_0$ is the total cross-sectional area of all the castings accommodated in the vessel and simultaneously subjected to electrohydroblasting.

The coefficient k is derived from this equation:

$$k = \frac{V}{s_0 h},$$

where $s_0$ is the cross-sectional area of the casting;

V is the volume of liquid passed through the holes of the casting; and h is the length of stroke of castings.

The stroke must be long enough for the liquid to wash the longest channel of the casting. In other words, the liquid which enters the channel must exit from it, i.e., $$h \geqq L \frac{v_0}{v},$$

where

L is the length of the longest channel of the casting, and v is the speed of reciprocating motion of the castings.

The loose sand in the internal cavities of the casting is caused to move back and forth and the cleaning is incomplete unless the above condition is complied with. According to hydrodynamic calculations, k=0.7 to 0.9 for flat wide castings with a large number of holes; for castings with narrow holes, k=0.2 to 0.4.

The flows of liquid caused by the reciprocating motion of the castings remove the loose core sand from the cavities and recesses of the castings. As the casting moves down, the liquid washes away the loose sand which clogs the outlet holes. As this takes place, the liquid is mixed with the sand and removes the latter from the casting through the hollows in its sides and upper surface. The removal of sand through the upper and lateral holes in addition to the removal of sand through the bottom holes of the casting considerably increases the rate of sand removal. As the casting moves upwards, the flows of liquid remove the sand from the casting through the lateral and bottom holes.

Similar events take place if the casting reciprocates in the horizontal plane, i.e., loose sand is removed from the casting through its top, bottom and side holes.

In order to increase the rate of the removal of loose sand from the internal cavities and recesses of the casting, the latter is accelerated at the moment it reverses its motion. The acceleration is greater than the free fall acceleration.

The resultant inertial forces $$F = ma,$$

where m is the mass of sand in an internal cavity, and a is the acceleration of the casting, are greater than the gravity force $$F = mg,$$

where g is the free fall acceleration. Particles of sand are separated by the inertial forces from the walls of the casting and washed away by the flow of liquid.

While castings are set in reciprocating motion, they are subjected to a series of electrohydraulic discharges. Reciprocation and discharges may alternate, i.e., the castings may be first subjected to a series of electrohydraulic discharges, then be set in reciprocating motion, then be again subjected to a series of electrohydraulic discharges, etc.

Figure 2:
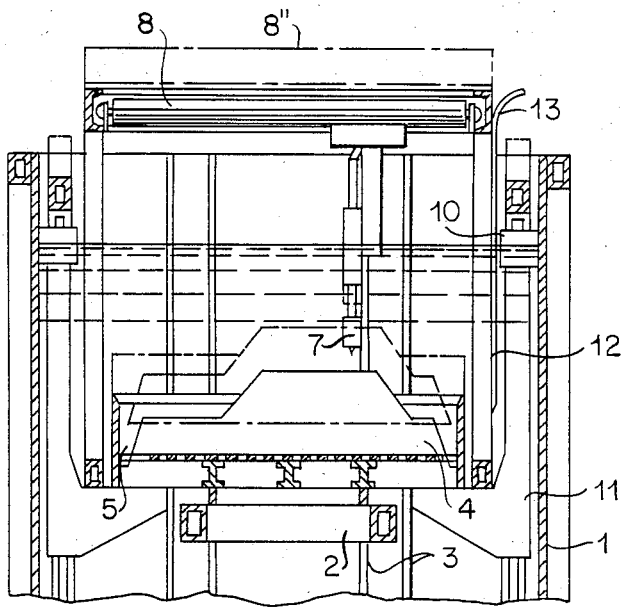
FIG. 2 is an elevation view of a casting-reciprocating mechanism according to the invention.

The method of this invention is carried out with the aid of an apparatus comprising a vessel 1 (FIGS. 1 and 2) filled with a working liquid, and a lifting platform 2 mounted in vertical guides 3 provided in the vessel 1. Castings 4 are placed in a container 5. The latter is put on the lifting platform 2 which can be moved to an unloading station. An electrode 7 is accommodated in the vessel 1 above the castings 4. The electrode 7 is driven by an electrode-positioning mechanism 8 and electrically connected to a pulse current generator 9.

The apparatus according to the invention further includes a mechanism 10 for setting the castings 4 in reciprocating motion, referred to below as the casting-reciprocating mechanism 10. This mechanism 10 is mounted on the vessel 1 and interacts with the mechanism 8. To make interaction of the mechanisms 10 and 8 possible, a platform 11 of the mechanism 10 is arranged inside the vessel 1 so that the mechanism 10 supports the container 5 and a frame 12 which carries the mechanism 8. The frame 12 is electrically connected to the pulse current generator 9 by a cable 13.

The vessel 1 rests on a reinforced concrete foundation 14 and is covered by a soundproof shell 15.

Figure 3:
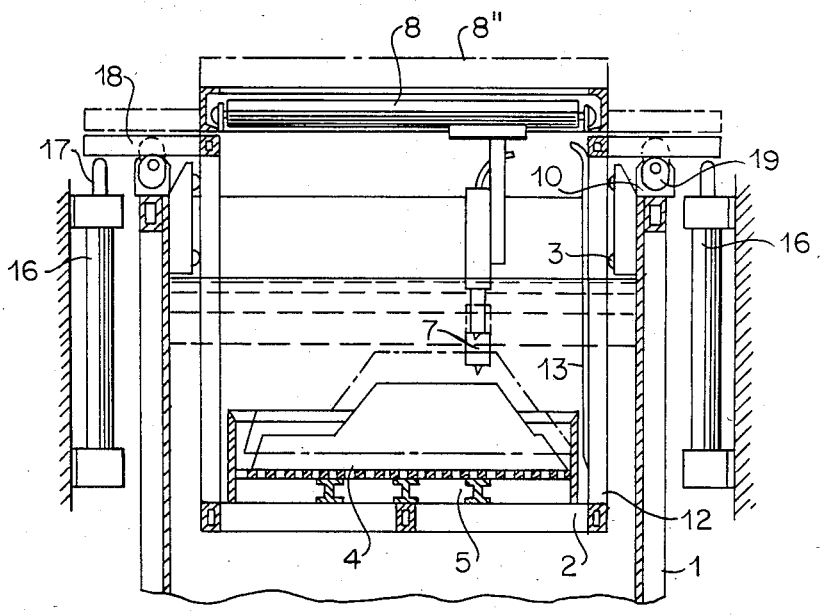
FIG. 3, FIG. 4 and FIG. 5 are elevation views of alternative embodiments of the casting-reciprocating mechanism according to the invention.

FIG. 3 shows an alternative embodiment of the electrohydroblasting apparatus according to the invention, in which the casting-reciprocating mechanism 10 and a mechanism 16 for driving the platform 2 both interact with the frame 12 rigidly coupled to the lifting platform 2. The actuators of the mechanism 16 are hydraulic cylinders whose rods 17 are in abutting relation with brackets 18 of the frame 12 and interact therewith when the frame 12 and platform 2 are in the lowermost position. The actuator of the mechanism 10 is an eccentric means 19 whose eccentricity is a multiple of the length of the stroke of castings during the electrohydroblasting process. The frame 12 is disposed in the vertical guides 3 of the vessel 1. With the mechanism 16 in the position corresponding to the lowermost position of the platform 2, the frame 12 can cyclically move with the electrode-positioning mechanism 8 mounted thereon, as well as with the lifting platform 2 and castings 4; at the same time the frame 12 interacts with the mechanism 10.

Figure 4:
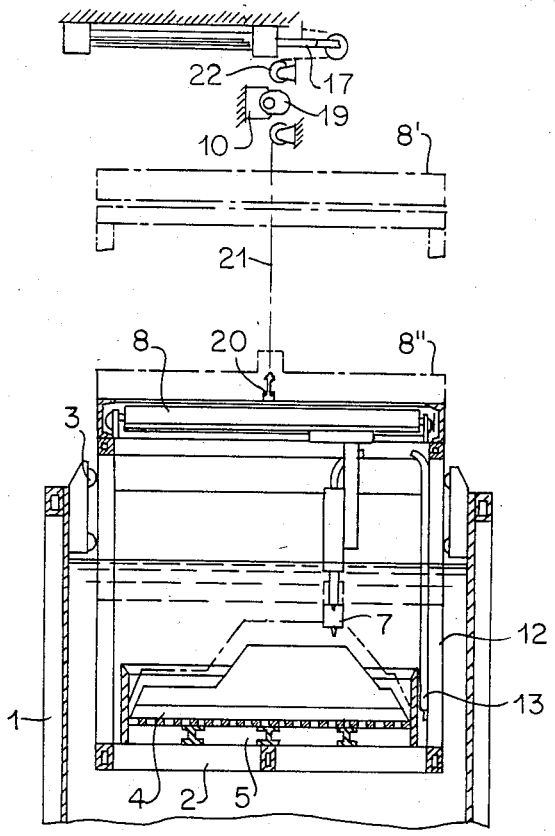

The embodiment of FIG. 4 differs from that of FIG. 3 in that the rod 17 of the actuator 16 is connected to an upper bar 20 of the frame 12 by means of a cable-and-tackle system 21. The eccentric actuator 19 of the mechanism 10 is disposed in the upper part of the system 21, between two end tackles 22.

Figure 5:
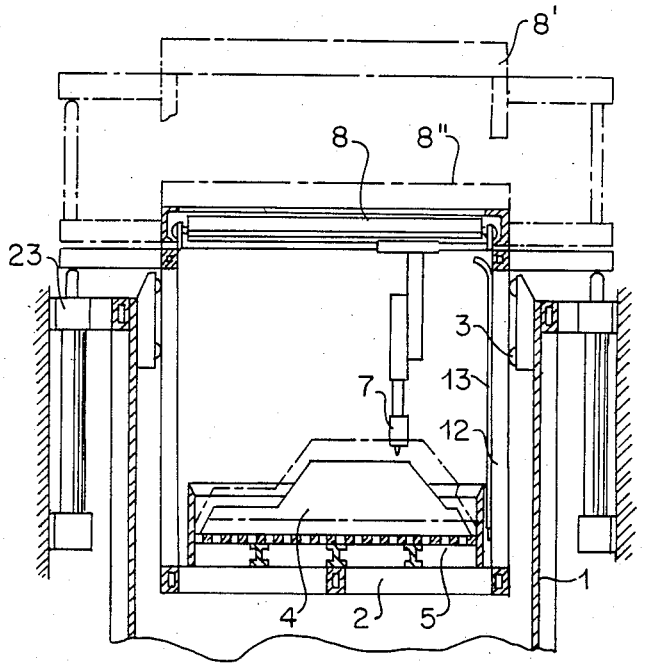

In the embodiment of FIG. 5, the mechanism 16 for driving the platform 2 and the casting-reciprocating mechanism 10 have a common two-stroke actuator 23 (FIG. 5). One stroke of the actuator 23 corresponds to the length of the stroke of castings during the electrohydroblasting process (position 8″ of the mechanism 8). The second stroke of the actuator 23 corresponds to the stroke of the lifting platform 2 while performing loading and unloading operations (position 8′ of the mechanism 8).

The apparatus functions as follows.

The castings 4 are placed in the container 5 found on the loading-unloading station (not shown). The mechanism 6 moves the container 5 with the castings 4 into the soundproof shell 15 and onto the lifting platform 2 mounted in the vertical guides 3 of the vessel 1 and found in its uppermost position. One or more electrodes 7 are moved to one of the castings 4 by the electrode-positioning mechanism 8 and placed at a desired point so that the spacing between the electrode 7 and casting 4 is equal to the discharge gap length. The platform 2, container 5 with castings 4, and electrode-positioning mechanism 8, which rests on frame 12 and platform 2, all move down and are submerged in the liquid filling the vessel 1.

Upon reaching the electrohydroblasting zone, the container 5 and frame 12 are brought to rest on the platform 11 of the mechanism 10 (position 8-8′), but the platform 2 continues to move down until it reaches its lowermost position so that a gap is produced between the platform 2, container 5 and movable frame 12.

The pulse current generator 9 is then brought into operation. The positive terminal of the generator 9 is connected to the electrode 7. The negative terminal of the generator 9 is connected by the cable 13 to the frame 12. High-voltage current pulses are applied to the electrode 7 to produce an electrohydraulic discharge in the liquid between the electrode 7 and the casting 4 which is electrically connected through the container 5, movable frame 12 and cable 13 to the pulse current generator 9.

The electrohydraulic discharge loosens the core and molding sand.

The casting-reciprocating mechanism 10 and the pulse current generator 9 may be actuated simultaneously; as an alternative, the mechanism 10 is actuated first, and the pulse current generator is brought into play after a specified period of time. The choice between the two alternatives depends on the type of core and molding sand, the material and shape of the castings, the shape of internal cavitives of the castings, and the rate at which the sand is loosened by electrohydraulic discharges. The period of time between the instant the mechanism 10 is actuated and the instant the generator 9 is switched on is specified for each type of casting. The mechanism 10 and generator 9 may be actuated alternately.

The mechanism 10 and platform 11 drive the container 5 with the castings 4, as well as the electrode 7, mechanism 8 and frame 12 into the vessel 1; all the driven members are set in synchronized reciprocating motion (position 8-8″).

Reciprocating motion of the castings 4, especially of those with developed internal cavities, results in flows of liquid which wash the loosened core sand away through the holes in the walls of the casting 4; they also wash away sand from the recesses in the casting 4.

The synchronized movement of the castings 4 and electrode 7 accounts for a constant length of the discharge gap and for optimum conditions for electrohydraulic discharges.

After the termination of the electrohydroblasting process, the platform 2 moves upwards and drives the container 5 with the castings 4, and the frame 12 with the electrode-positioning mechanism 8 to their uppermost position. The mechanism 6 then drives the container 5 with the castings 4 to the loading-unloading station.

The electrohydroblasting apparatus according to the invention removes 99.9 percent of core and molding sand from internal cavities of castings, which is a significant improvement over conventional apparatus.

What is claimed is:

1. An apparatus for electrohydroblasting of castings with a view to removing core and molding sand therefrom, comprising:

a vessel to accommodate castings to be electrohydroblasted;

a working liquid filling said vessel and having a conductivity level required for the electrohydroblasting process;

an electrode submersible in said working liquid so that a discharge gap is formed between said electrode and the surface of the castings to be electrohydroblasted;

a pulse current generator electrically connected to said electrode so as to apply current pulses to said discharge gap and thus produce a series of electrohydraulic shocks in said working liquid to loosen and remove core and molding sand from the castings;

a lifting platform to carry the castings to be electrohydroblasted;

vertical guides installed in said vessel;

a mechanism for driving said lifting platform along said guides, having an actuator interacting with said lifting platform;

a mechanism for positioning said electrode, mounted above said vessel for positioning said electrode in relation to the castings so as to form said discharge gap;

a mechanism for setting the castings in reciprocating motion and thus providing conditions for the removal of core and molding sands from the internal cavities of the castings, coupled to said lifting platform, said casting-reciprocationg mechanism having a platform arranged in said vessel on said lifting platform to carry castings to be electrohydroblasted;

means for synchronizing said electrode-positioning mechanism and said casting-reciprocating mechanism so as to maintain a constant width of said discharge gap;

a frame mounted on said platform and coupled to said electrode-positioning mechanism so that the latter is in abutting relation with said platform, whereby movement of said electrode is synchronized with that of the castings; and an actuator interacting with said platform.

2. An apparatus as claimed in claim 1, wherein said frame is electrically connected to said pulse current generator.

3. An apparatus for electrohydroblasting of castings with a view to removing core and molding sand therefrom, comprising:

a vessel to accommodate castings to be electohydroblasted;

a working liquid filling said vessel and having a conductivity level required for the electrohydroblasting process;

an electrode submersible in said working liquid so that a discharge gap is formed between said electrode and the surface of the castings to be electrohydroblasted;

a pulse current generator electrically connected to said electrode so as to apply current pulses to said discharge gap and thus produce a series of electrohydraulic shocks in said working liquid to loosen and remove core and molding sand from the castings;

a lifting platform to carry the castings to be electrohydroblasted;

vertical guides installed in said vessel;

a mechanism for driving said lifting platform along said guides, having an actuator interacting with said lifting platform;

a mechanism for positioning said electrode, mounted above said vessel for positioning said electrode in relation to the castings so as to form said discharge gap;

a mechanism for setting the castings in reciprocating motion and thus providing conditions for the removal of core and molding sands from the internal cavities of the castings, coupled to said lifting platform;

means for synchronizing said electrode-positioning mechanism and said casting-reciprocating mechanism so as to maintain a constant width of said discharge gap;

a frame coupled to said lifting platform mounted in said vertical guides to be reciprocated in said guides by said casting-reciprocating mechanism; and an actuator of said casting-reciprocating mechanism.

4. An apparatus as claimed in claim 3, wherein said casting-reciprocating mechanism has an eccentric means whose eccentricity is a multiple of the length of the stroke of castings during the electrohydroblasting process.

5. An apparatus as claimed in claim 3, wherein said actuator of said mechanism for driving said lifting platform also serves as the actuator of said casting-reciprocating mechanism.

* * * * *